US007442006B2

(12) United States Patent
Nguyen et al.

(10) Patent No.: US 7,442,006 B2
(45) Date of Patent: Oct. 28, 2008

(54) INTEGRAL DIFFUSER AND DESWIRLER WITH CONTINUOUS FLOW PATH DEFLECTED AT ASSEMBLY

(75) Inventors: Ly D. Nguyen, Phoenix, AZ (US); Gary A. Shoff, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 543 days.

(21) Appl. No.: 11/204,640

(22) Filed: Aug. 15, 2005

(65) Prior Publication Data

US 2007/0036646 A1 Feb. 15, 2007

(51) Int. Cl.
*F01D 1/02* (2006.01)

(52) U.S. Cl. ..... 415/208.4; 415/211.2; 29/889.22

(58) Field of Classification Search ..... 415/208.3, 415/208.4, 211.2; 29/889.22
See application file for complete search history.

(56) References Cited

U.S. PATENT DOCUMENTS

| | | | | |
|---|---|---|---|---|
| 4,027,997 | A | 6/1977 | Bryans | |
| 4,344,737 | A | 8/1982 | Liu | |
| 4,854,126 | A | 8/1989 | Chevis et al. | |
| 4,981,018 | A | 1/1991 | Jones et al. | |
| 5,274,992 | A | 1/1994 | Klaass et al. | |
| 5,555,721 | A | 9/1996 | Bourneuf et al. | |
| 6,279,322 | B1 | 8/2001 | Moussa | |
| 6,418,723 | B1 | 7/2002 | Gladden | |
| 6,494,677 | B1 * | 12/2002 | Grady | 415/209.4 |
| 6,585,482 | B1 | 7/2003 | Liotta et al. | |
| 6,589,015 | B1 | 7/2003 | Roberts et al. | |
| 2005/0095127 | A1 * | 5/2005 | Sasu et al. | 415/208.4 |
| 2005/0158173 | A1 | 7/2005 | Nguyen et al. | |

* cited by examiner

*Primary Examiner*—Richard Edgar
(74) *Attorney, Agent, or Firm*—Ingrassia, Fisher & Lorenz, P.C.

(57) ABSTRACT

An integrated assembly is provided for a centrifugal compressor, which integrates selected static portions of the centrifugal compressor into a monolithic structure to allow a small deflection of the inner flow path at assembly. The integrated assembly may include a machined compressor shroud casting having integral diffuser vanes, an aft sheet metal inner flow ring having a radially extending rim with slots in the inner flow ring for receiving diffuser vanes and slots in the rim for receiving deswirler vanes, an outer deswirler band surrounding the inner flow ring and having slots opposing those in the rim, and a plurality of deswirler vanes for fabrication between the inner flow ring and the deswirler band within the respective slots.

13 Claims, 8 Drawing Sheets

INTEGRAL DIFFUSER AND DESWIRLER WITH CONTINUOUS FLOW PATH DEFLECTED AT ASSEMBLY

BACKGROUND OF THE INVENTION

The present invention generally relates to an apparatus comprising an integral diffuser and deswirler for a centrifugal compressor and a method for fabricating and assembling the parts comprising the integral diffuser and deswirler.

The centrifugal compressor is an apparatus typically used to increase the flow of the incoming air to the combustion chamber of a gas turbine engine. These centrifugal compressors are often comprised of an impeller for accelerating an incoming, axially directed airflow to increase its kinetic energy; a radially vaned diffuser surrounding the impeller to decrease the velocity of the airflow emerging about the circumference of the impeller and thereby increase its static pressure; a path having a 90° bend to redirect the radial airflow once again into an axially oriented direction; and a plurality of axially arranged deswirler vanes to reduce turbulence in the axially oriented airflow by converting the high tangential velocity component of the airflow exiting the diffuser to a more useful static pressure. Such centrifugal compressors are often used in aircraft auxiliary power units (APU), since they are relatively light, compact, and highly efficient for their weight.

In order to illustrate the issues that arise in fabricating a centrifugal compressor, FIG. 1 is provided, showing a typical centrifugal compressor 100 illustrative of the prior art. An upper portion of the centrifugal compressor 100 is shown as being symmetrical about a compressor centerline 130, with the lower portion omitted. The modules both forward and aft of the static portions of the centrifugal compressor are similarly omitted for ease of illustration. An impeller turbine 120, to which a plurality of impeller vanes 110 are attached, rotates about an axis of rotation coincident with the compressor centerline 130 to axially draw an airflow 140 through an inlet of a bleed port 150. The axially oriented airflow 140 is accelerated and compressed by rotation of the impeller turbine 120 to that it is expelled in a radial direction along the outer edges of the impeller vanes 110. The airflow 141 emerging from between the impeller vanes 110 may be directed radially through a passage having a forward wall defined by a shroud 151, a forward diffuser wall 152, and an outer deswirler wall 153, the passage also having an aft wall defined by an impeller back shroud 154, an aft diffuser wall 155, and an inner deswirler wall 156, the wall being formed by the assembly. The airflow 141 is directed by the passage through a plurality of diffuser vanes 160 where the velocity of the airflow 143 is reduced prior to entering into the combustion chamber 145. A 90° bend 170 redirects the airflow 143 again into an axial direction where it passes through a plurality of deswirler vanes 180 that remove centrifugal motion from the airflow 143 and direct the airflow 144 to a combustion chamber 145. The edges of the forward and aft diffuser walls 152, 155 may be mated to the outer and inner deswirler walls 153, 156 at mating points 192, 194, respectively. It can be seen that these mating points 192, 194 may provide discontinuities in the outer and inner passage walls, respectively. These discontinuities may allow leak paths to develop as the different parts thermally expand and contract. Leak paths may also develop if the parts become warped, misaligned, or flexed by applying compressive force through fastener 190 and fastener 195 when the assembly is attached to the gas turbine engine. Furthermore, improper or loose assembly can cause fretting and wearing that can reduce engine performance, adversely affect reliability, and lead to premature failure.

The diffuser and deswirler components of the typical centrifugal compressor are generally constructed as a separate module that is attached to the gas turbine engine by one or more fasteners. This module may be constructed by assembling a number of components, each of which may be fabricated using standard sheet metal techniques well known to the industry. These components may be interconnected by using standard fabrication methods well known in the art. For example, the edges of two such components may be held together by providing the edges with duct tails, bayonet fittings, simply supported edges abutting one another, or clamped ends, to name several common fabrication methods. Such fabrication methods may make the module cumbersome and difficult to assemble and align according to required tolerances for efficient operation. They may also require many additional parts, such as numerous fasteners; require additional features to be incorporated into the component that are unrelated to its function, e.g. bayonet fittings; be expensive to manufacture; and be prone to fretting, wearing, and other undesirable actions caused by vibration of the parts against one another during operation of the gas turbine engine. Furthermore, utilizing multiple components for the fabrication of the module may often result in a discontinuous flow path along the junctions of the components, particularly along the inner passage walls, which can result in turbulence and undesirable leak paths, both of which may have a negative effect on engine performance. Finally, the close tolerances and clearances between these components, which enhance the performance of the gas turbine in general, may be negated because of limitations in manufacturing methods of the components and by the cumulative build up of these tolerances.

The diffuser and deswirler components may also be constructed as a single module by casting the diffuser and deswirler components in a single, monolithic structure. However, casting may require a thicker structure, which in turn may result in increased weight of the module. Such increased weight is undesirable in an aircraft assembly. Also, complex shapes may be difficult to achieve by casting and may require multiple casting, careful alignment, and further machining, all of which increase labor cost. Usually some combination of casting and sheet metal fabrication is used, but not always. U.S. Pat. No. 4,854,126, to Chevis, discloses a diffuser system fabricated using a one-piece casting having the diffuser vanes and the deswirler vanes integral with the casting. The assembly has an annular central hub which enables the cast housing to be slid into the turbine casing about the shaft of the turbine engine for positioning at the end of the engine. The one-piece casting must be machined to appropriate finished surface tolerances after casting, which adds to the time and cost for assembly. Installation of the casting requires removal of the impeller disk and insertion of the turbine shaft through the bearing surfaces of the annular central hub. An intake structure is then bolted to the engine casing over the casting to precisely mate with the diffuser and deswirler vanes to form airflow passages therethrough.

In today's competitive APU engine market, a low weight, high performance, and low cost design is often desirable. As can be seen, there is a need for an integrated assembly to perform the diffuser and deswirler functions in a centrifugal compressor, where the integrated assembly is lightweight, not prone to turbulence and leak paths along its airflow path, easy to construct and fabricate. The assembly of such an integrated assembly should not promote the accumulation of close tolerances that would detract from the efficiency of the module.

SUMMARY OF THE INVENTION

An integrated assembly is provided, where the integrated assembly comprises a shroud coaxial with a central axis, the shroud having a downstream surface; a plurality of diffuser vanes fixedly attached to and extending axially from the downstream surface; a ring coaxial with the central axis, the ring having an upstream surface disposed for fixed attachment to the plurality of diffuser vanes, the ring with a rim extending axially from a perimeter of the ring and away from the downstream surface; a band disposed coaxially with and surrounding the rim, the band having an upstream edge proximate the downstream surface and a downstream edge distal from the downstream surface, the band having an outwardly-extending flange; and a plurality of deswirler vanes positioned between the rim and the band, each vane fixedly attached to the band and the rim.

The invention also provides an integrated assembly for a centrifugal compressor on an engine body of a gas turbine engine with a central axis, where the centrifugal compressor has an impeller disposed to receive an axially oriented airflow, accelerate the airflow, and expel the airflow radially, and the centrifugal compressor further has a compressor body. The integrated assembly comprises a shroud coaxial with and orthogonal to the central axis, the shroud surrounding the impeller and providing an inlet receiving the axially oriented airflow, the shroud having a plurality of diffuser vanes integral with the shroud and extending axially from a downstream surface of the shroud; a ring coaxial with and orthogonal to the central axis, the ring having an upstream surface disposed for fixed attachment to the plurality of diffuser vanes, the ring with a rim extending axially from a perimeter of the ring and away from the downstream surface of the shroud; a continuous band disposed coaxially with and surrounding the rim, the band having an upstream edge proximate to the downstream surface and a downstream edge distal to the downstream surface, the band having an outwardly-extending flange along the downstream edge; and a plurality of deswirler vanes attached to the rim and the band to hold the rim and the band in spaced relationship. The integrated assembly is so disposed that the radially oriented airflow expelled from the impeller flows through a diffuser passage formed between the shroud and the ring and flows thereafter through a deswirler passage formed between the rim and the band.

Furthermore, the invention provides a centrifugal compressor for attachment to a gas turbine engine, with the centrifugal compressor comprising an impeller coaxial with a central axis of the engine body; an inlet receiving an axially oriented airflow and directing the airflow through the impeller; an integrated assembly that comprises a shroud coaxial with and orthogonal to the central axis, the shroud surrounding the impeller, the shroud with a downstream surface; a ring coaxial with and orthogonal to the central axis, the ring having an upstream surface; the ring with a rim orthogonal with the upstream surface and extending axially from a perimeter of the ring and away from the downstream surface of the shroud; a plurality of diffuser vanes affixed to both the upstream surface of the ring and the downstream surface of the shroud, so that the surfaces are held in fixed and spaced relationship to form a diffuser passage for radially directed airflow from the impeller; a continuous band disposed coaxially with and surrounding the rim, the band having an upstream edge proximate to the downstream surface of the shroud and a downstream edge distal to the downstream surface of the shroud, the band having a flange that extends away from the central axis; and a plurality of deswirler vanes affixed to both the rim and the band wherein the rim and the band are held in fixed and spaced relationship to form a deswirler passage for axially directed airflow. The centrifugal compressor also comprises a compressor housing coaxial with and orthogonal to the central axis, the compressor housing having a compressor housing edge, the compressor housing edge removably attached to an engine housing and holding the integrated assembly therebetween against the engine housing. These components are arranged so that the airflow radially expelled from the impeller flows through a diffuser passage formed between the shroud and the ring, becomes redirected axially as it flows through a redirection passage, and flows thereafter through a deswirler passage formed between the rim and the band.

A method of fabricating an integrated assembly for a centrifugal compressor is also provided, where the method comprises providing an assembly jig defining a first datum plane and a second datum plane parallel with the first datum plane, the assembly jig being coaxial with and orthogonal to a central axis; centrally positioning a compressor shroud having a plurality of diffuser vanes extending from a downstream surface of the compressor shroud, the compressor shroud positioned between the first and second datum planes about a central axis of the assembly jig; positioning an inner flow ring within the assembly jig in alignment against the diffuser vanes, the inner flow ring having a rim around a perimeter of the inner flow ring, the rim extending away from the downstream surface; positioning a deswirler band in alignment with the second datum plane and surrounding the rim; positioning a plurality of deswirler vanes between the deswirler band and the rim of the inner flow ring; affixing the plurality of diffuser vanes and the plurality of deswirler vanes to the inner flow ring and the deswirler band to form an integrated assembly; and re-indexing the integrated assembly from the second datum plane back to the first datum plane.

These and other features, aspects and advantages of the present invention will become better understood with reference to the following drawings, description and claims.

DETAILED DESCRIPTION OF THE INVENTION

Figure 1:
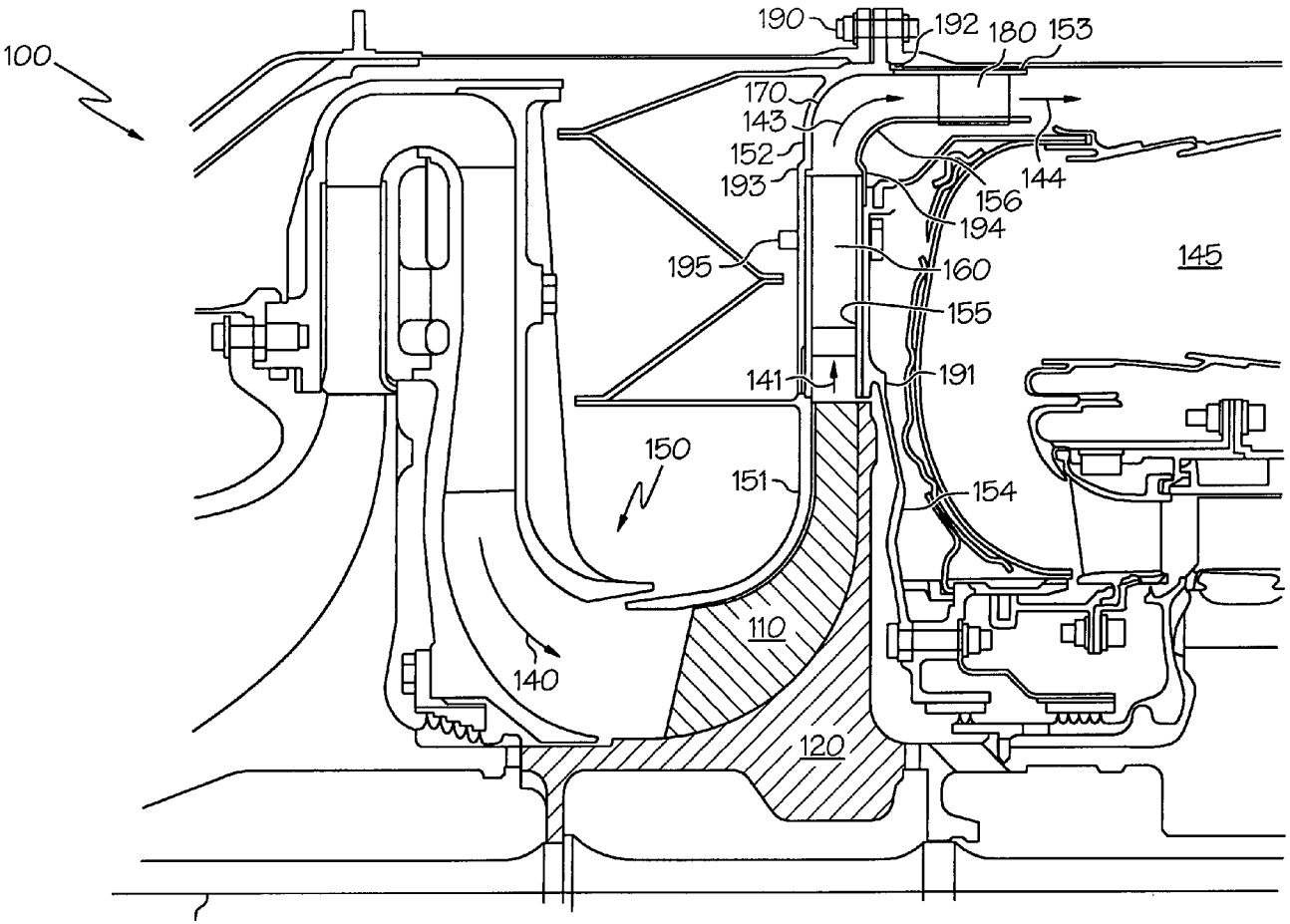
FIG. 1 (PRIOR ART)
FIG. 1 is a cross-sectional view of a centrifugal compressor showing a typical arrangement of shroud, diffuser, and deswirler components, according to the prior art.

The following detailed description is of the best currently contemplated modes of carrying out the invention. The description is not to be taken in a limiting sense, but is made merely for the purpose of illustrating the general principles of the invention, since the scope of the invention is best defined by the appended claims.

This invention may be used to improve the weight characteristics and performance of existing gas turbine engines that utilize a centrifugal compressor design. In particular, the present invention may find application in the field of commercial and military aviation for use in standard centrifugal compressors for gas turbine engines, such as those utilized as auxiliary power units (APU) and emergency power units (EPU). The present invention may also be used in other areas of commerce where centrifugal compressors are utilized.

Centrifugal compressors that are used with gas turbine engines according to the prior art typically have a diffuser component and a deswirler component. These components are either cast as a single unit, constructed of numerous discrete sheet metal parts, or fabricated as some combination of castings and sheet metal. The static portions of the centrifugal compressor may generally comprise a compressor shroud surrounding an impeller, a radially-vaned diffuser assembly, a 90° bend, and axial deswirler vanes. These static portions are usually assembled as a module for attachment to the gas turbine engine over and around the impeller that brings air into the engine. Assembly of the static portions into a single module may involve the mating of the various edges of these static portions, with passages formed therebetween for the flow of incoming air. Edges of the components, when present, may be mated using standard techniques known to the art. However, such mating techniques may result in discontinuities along the air flow passages, which may cause unwanted turbulence in the air flow, resulting in loss of efficiency in the engine, or form leak paths. Vibration caused by the normal operation of the gas turbine engine may cause the edges to similarly vibrate against each other, resulting in fretting, wearing, and sympathetic vibration. Finally, these static portions must be assembled very precisely in order to control individual assembly tolerances and to prevent these individual tolerances from accumulating to the point where they adversely affect the overall tolerance of the module.

In contrast to the prior art, the present invention provides an article of manufacture that reduces the quantity and quality of the discontinuities along the air flow path, while benefiting from both the casting and sheet metal advantages. An inventive integrated assembly is provided, which includes a machined compressor shroud with integral diffuser vanes, an aft sheet metal inner flow ring with slots for both diffuser and deswirler vanes, a plurality of deswirler vanes, and an outer deswirler band with a mating flange, where all parts are coaxial with and symmetrical about a common central axis. These components may be easily assembled by sequentially inserting them into a special jig for brazing the components together, thus eliminating the need for separate fasteners and mating of edges. The jig may control the assembly of the components to eliminate the tolerance buildup of individual tolerances of the individual components by carrying out the assembly according to two datum planes. Furthermore, this arrangement of components substantially eliminates discontinuities along the inner air flow path, while allowing the outer end of the air flow path to flex in order to accommodate assembly compliance. As an added advantage, the integrated assembly may eliminate the air leakage and recirculation that often occurs in both radial and axial directions between multiple mating surfaces during assembly. Finally, all fretting, wearing, and undesirable vibration between parts may be eliminated because there is more rigid contact on the datum planes and no mated edges within the integrated assembly.

It should be noted that the terms "upstream", "forward", "downstream", and "aft" as used herein will be in relationship to the airflow 202 (FIG. 2), with "upstream" or "forward" referring to a direction opposing the airflow 202 and "downstream" or "aft" referring to a direction aligned with the airflow 202.

Figure 2:
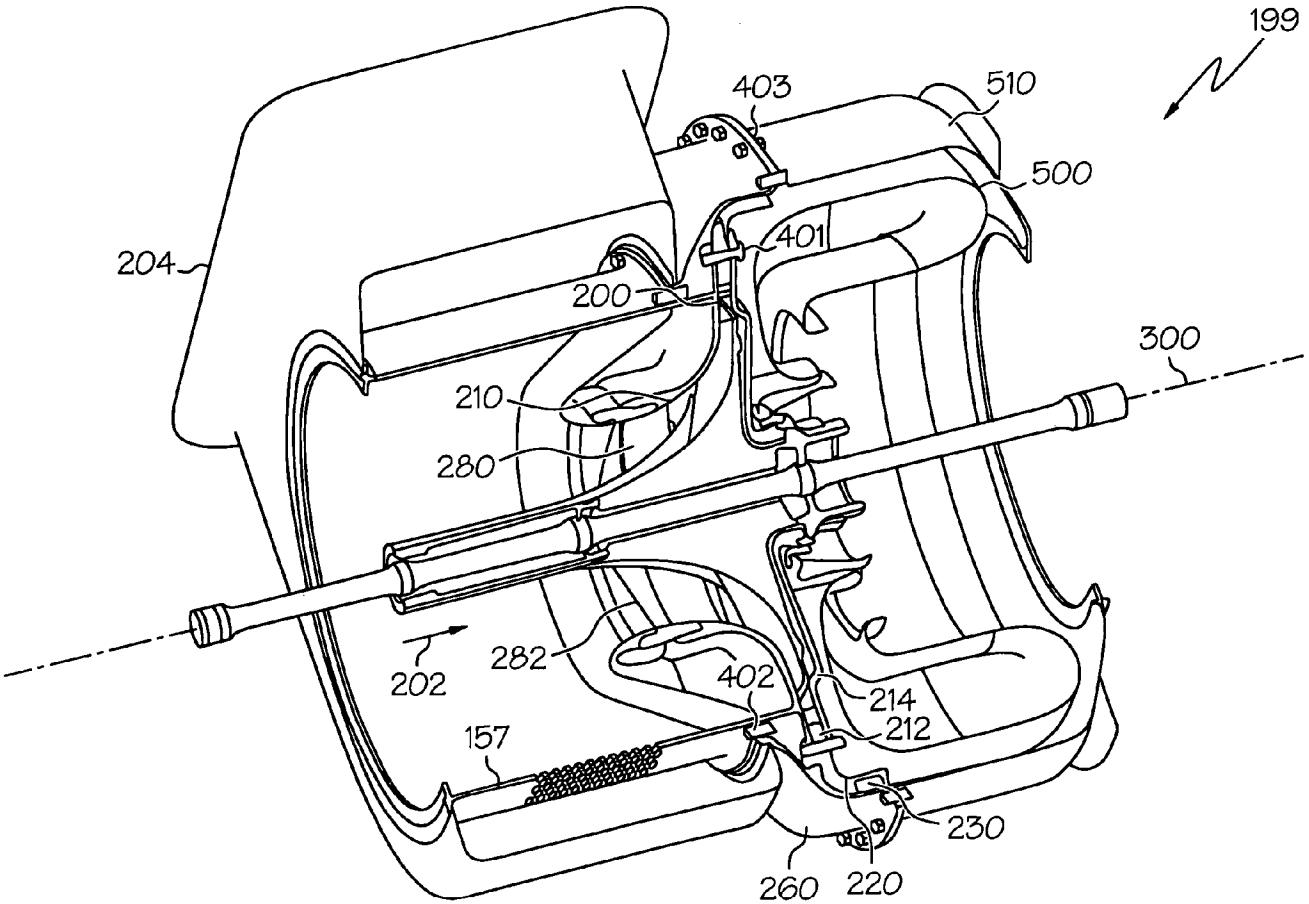
FIG. 2 is a cut away perspective view of a centrifugal compressor having an integrated diffuser and deswirler fabricated according to an embodiment of the present invention.
Figure 3:
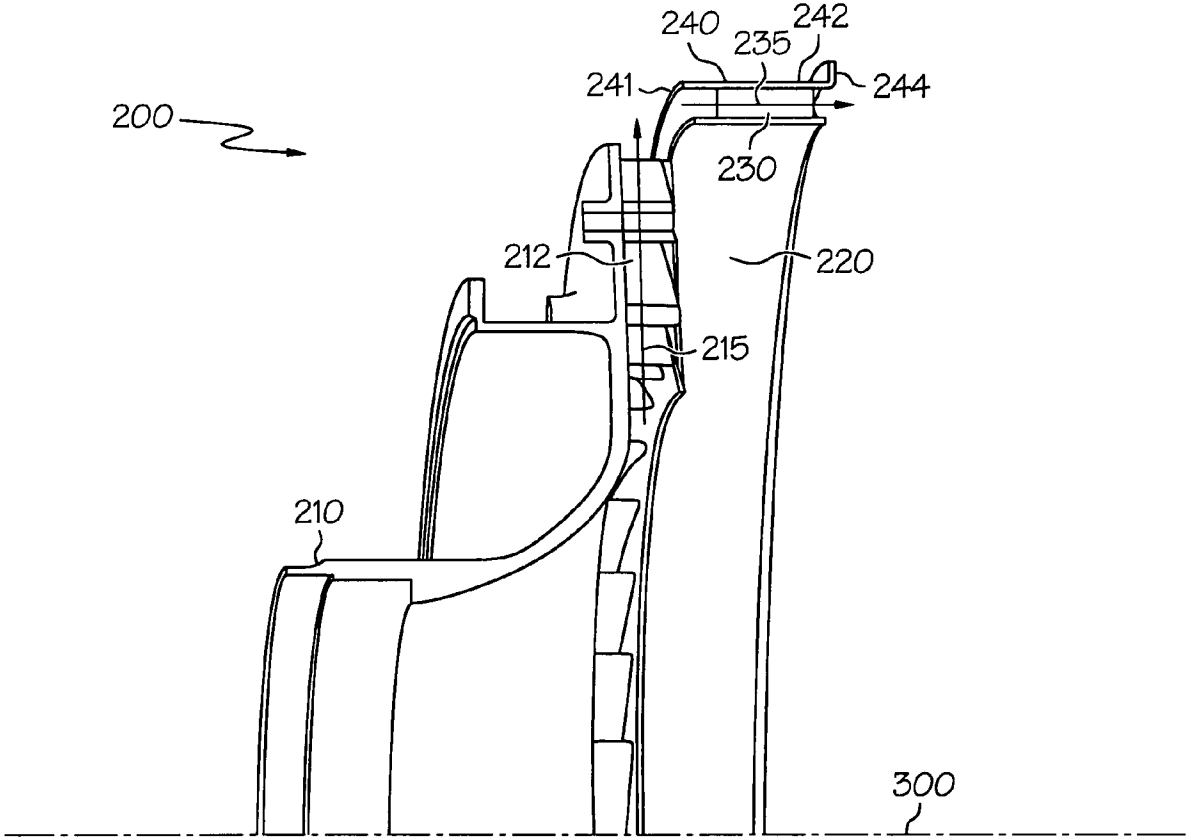
FIG. 3 is a perspective, cross-sectional view of an assembled integrated assembly showing how components of the integrated assembly are assembled, according to an embodiment of the invention.
Figure 4:
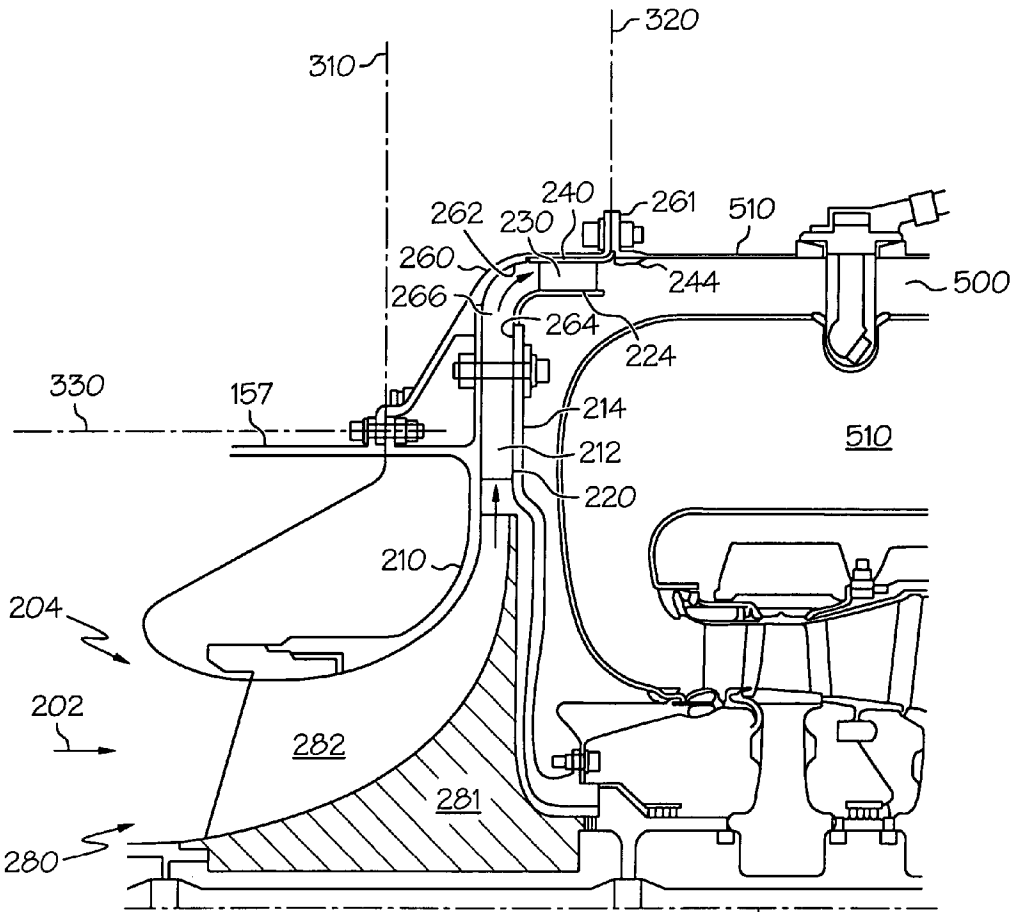
FIG. 4 is a cross-sectional, plan view of an integrated assembly in an installed position on a gas turbine engine, according to an embodiment of the invention.
Figure 5:
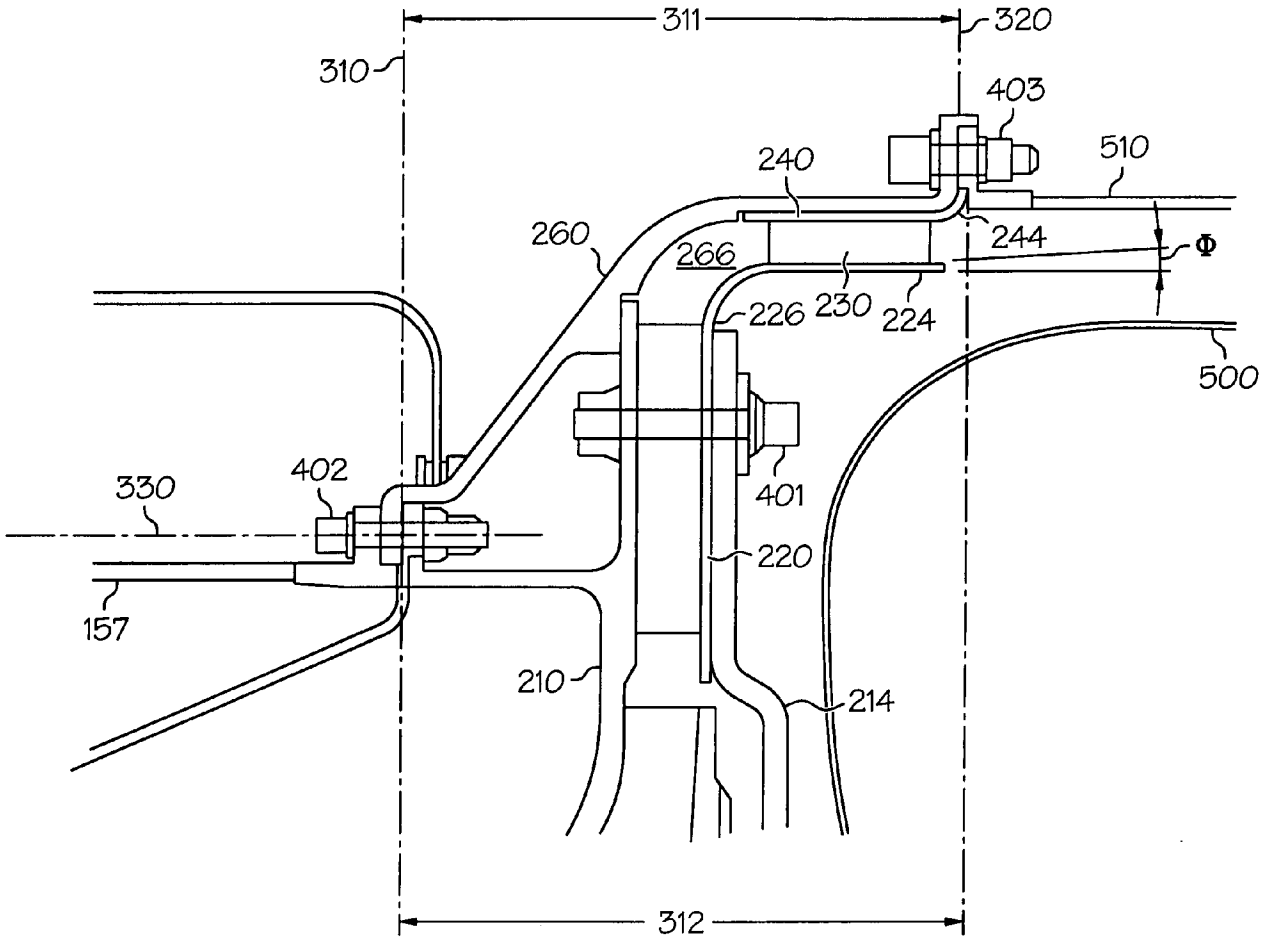
FIG. 5 is a more detailed, cross sectional plan view of an integrated assembly showing datum planes and the deflection angle, according to an embodiment of the invention.

Referring now to FIG. 2, a perspective view of a centrifugal compressor 199 is shown with a portion cut away to illustrate the interior of the centrifugal compressor with a diffuser and deswirler in an integrated assembly 200 fabricated according to an embodiment of the invention. FIG. 3 shows a perspective view of the integrated assembly 200 after its components have been assembled. The integrated assembly 200 may include static portions of a centrifugal compressor that direct axially oriented airflow to a combustion chamber of a gas turbine engine 500 (FIG. 5). A compressor shroud 210 may surround an impeller 280 (FIG. 5) of the centrifugal compressor, so that axially oriented airflow 202 may be directed through an inlet 204 into the engine. The shroud 210 may be constructed by casting or machining, with a plurality of diffuser vanes 212 extending axially from its downstream surface. The diffuser vanes 212 may be spaced around the inlet 204 so that they are positioned to receive a radially oriented airflow emerging from the impeller 280. An inner flow ring 220 may be attached collectively to each of the diffuser vanes 212 to form a diffuser passage between the inner flow ring 220 and the diffuser vanes 212 (FIG. 4). A plurality of slots 221 may be fabricated into an upstream surface 222 of the inner flow ring 220, which may be orthogonal to a central axis 300 of the engine, in order to facilitate attachment of the diffuser vanes 212.

The inner flow ring 220 may also have a rim 224 that extends axially away from the compressor shroud 210. The rim 224 may be in a perpendicular orientation with the plane of the upstream surface 222 to form an approximate 900 bend. A plurality of deswirler vanes 230 may then be attached along an outer surface of the rim 224. A plurality of slots 223 may be fabricated into the rim 224 of the inner flow ring 220 in order to facilitate attachment of the deswirler vanes 230. A deswirler band 240 may then be fabricated around the deswirler vanes 230 and attached thereto, so that the deswirler vanes 230 may be held in an axial orientation. The deswirler band 240 may have an outwardly extending flange 244 along its downstream edge 242 to provide attachment to the compressor housing 260, as will be seen presently. Again, a plurality of slots 225 may be provided along the deswirler band 240 between its upstream edge 241 and downstream edge 242 to facilitate attachment of the deswirler vanes 230, so that each deswirler vane 230 may be aligned and positioned by opposing slots 223, 225 for permanent fixation. A deswirler passage 235 may be thus formed between the deswirler band 240 and the inner flow ring 220. The integrated assembly 200 may be coaxial with and share a common central axis 300 with the gas turbine engine 500.

Referring now to FIG. 5, a cross sectional view of an integrated assembly 200 may be seen in an installed position on a gas turbine engine 500, according to an embodiment of the invention. The static components of the integrated assembly 200 may include a compressor shroud 210 with integral diffuser vanes 212 extending therefrom, an inner flow ring 220, a deswirler band 240, and deswirler vanes 230 positioned between the deswirler band 240 and the inner flow ring 220. A flange 244 may be fabricated along a downstream edge 242 of the deswirler band 240 to align the static components within a compressor housing 260 for attachment to the gas turbine engine 500. The flange 244 may be captured by a compressor housing edge 261 and held firmly against an engine housing 510 of the gas turbine engine 500. A seamless, continuous inner airflow wall 264 may thus be formed by the inner flow ring 220.

The compressor housing 260 may partially form an outer airflow wall 262 with the compressor shroud 210 and the deswirler band 240, so that the inner airflow wall 264 and the outer airflow wall 262 define a redirection passage 266 through which an airflow expelled radially from the impeller blades 282 may flow first radially and then be redirected about 90° to flow axially to a combustion chamber 510 of the gas turbine engine 500. This redirection passage 266 may thus be formed by the compressor housing 260, the inner flow ring 220, and the rim 224. The compressor housing 260 may also define a first datum plane 310 and a second datum plane 320, each plane 310, 320 being orthogonal with the central axis 300 and parallel with each other, so that the integrated assembly 200 including the compressor shroud 210, inner flow ring 220, and deswirler band 240 are rigidly supported in spaced relationship therebetween. Radial datum 330 may be considered as a reference line parallel with the central axis 300 for alignment purposes, so that the various components may be aligned as a practical matter with a point on the compressor shroud 210 where they are joined together.

Referring again to FIG. 5, it may easily be seen that, once assembled, the integrated assembly 200 has only two dimensions 311, 312 of interest that may be controlled for assembly and installation. A first dimension 311 may be measured between inner planes of the compressor housing 260. A second dimension 312 may be measured between a plane of the compressor shroud 210, the plane being flush with and coincident with the inner plane of the compressor housing 260 at radial datum 330, and a plane of the flange 244. The difference between first dimension 311 and second dimension 312 may define an axial tolerance scalar. Furthermore, the dimension 311 is always greater than dimension 312 to create a value for the axial tolerance scalar may typically be approximately 0.015 inch. The axial tolerance scalar may be used to define a deflection angle $\phi$ and a residual axial loading that are required during installation to maintain rigid contact between the integrated assembly 200, the compressor housing 260, and the gas turbine engine 500.

Installation of the integrated assembly 200 may be accomplished by inserting the compressor housing 260 into the inlet housing 157 and securing the two housings 260, 157 and inserting second fasteners 402 through holes defined by the radial datum 330. Next, the integrated assembly 200 may be inserted into the compressor housing 260 and secured with second fasteners 402. After the radial compressor and other appropriate rotating structures are in place, a compressor back shroud 214 may be secured to the integrated assembly 200 using one or more first fasteners 401, so that the integrated assembly 200 may be fixedly aligned about the central axis 300. The compressor housing 260 may then be attached using second fasteners 402 and third fasteners 403, so that it encloses the integrated assembly 200 and bears down on the flange 244. As the third fastener 403 is tightened to bring the compressor housing 260 compressively against an engine housing 510 of the gas turbine engine 500, the axial loading against flange 244 may force the integrated assembly 200 to flex at location 226, so that location 227 may be deflected inwardly through deflection angle $\phi$. This deflection may occur without producing discontinuities in the inner airflow wall 264.

Figure 6:
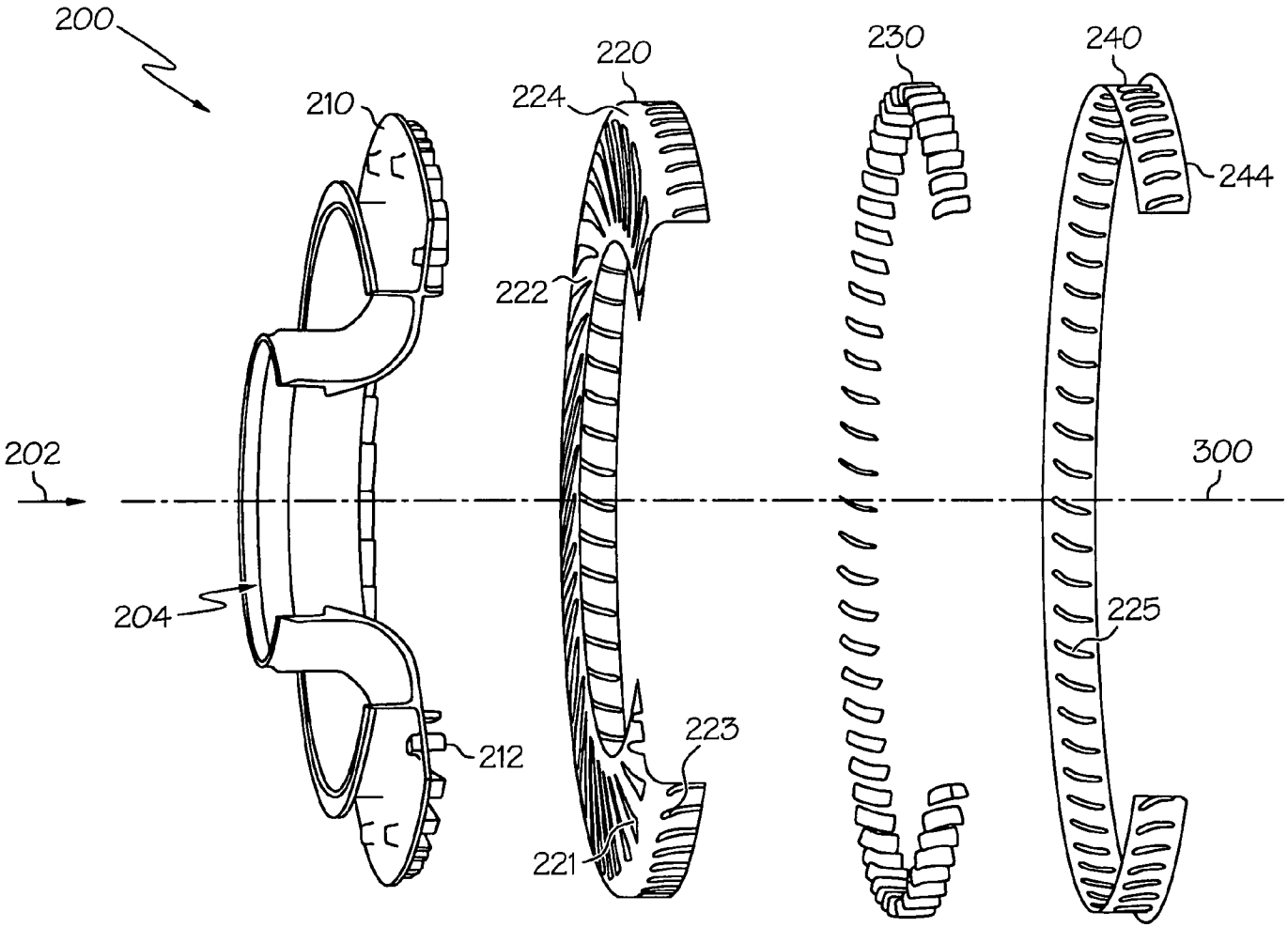
FIG. 6 is an exploded perspective view of an integrated diffuser and deswirler assembly showing its individual parts, according to an embodiment of the present invention.
Figure 7:
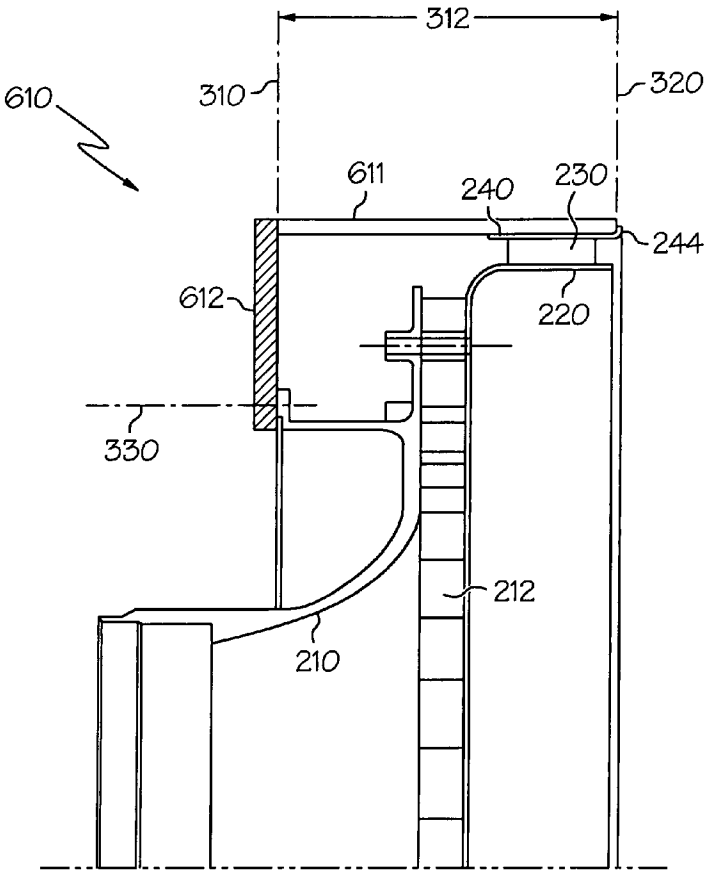
FIG. 7 is a cross sectional view of an assembly jig showing datum planes and how components of the integrated assembly are held for assembly, according to an embodiment of the invention.
Figure 8:
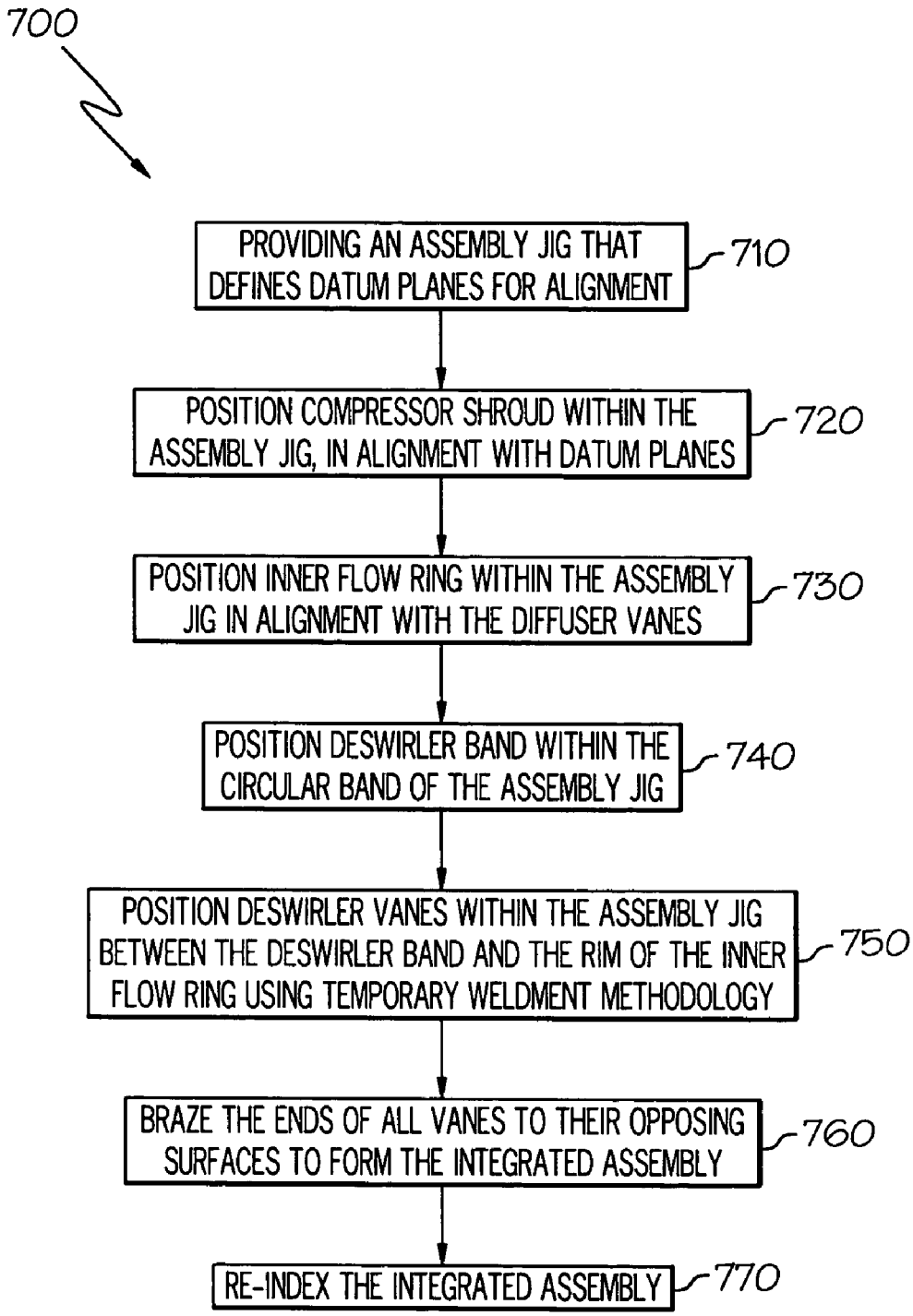
FIG. 8 is a flow chart of a method of fabricating an integrated assembly, according to an embodiment of the invention.

The invention further provides a method of fabricating the integrated assembly 200 in such a way that dimensional control of the final assembly may be easily maintained. FIG. 6 shows an exploded view of the individual components of assembly 200 prior to assembly into the jig 610. FIG. 7 depicts an assembly jig 610 consisting of a circular band 611 with a width of the first dimension 312 and an inwardly-extending jig ring 612 orthogonal to the circular band 611 to define the first datum plane 310. FIG. 8 may illustrate a method 700 for fabricating the integrated assembly 200. In a block labeled 710, an assembly jig 610 may be provided, in which the datum planes 310, 320 and the radial datum 330 may be defined. The compressor shroud 210 may be positioned within the assembly jig 610 in alignment with the datum planes 310, 320, according to the block labeled 720, and affixed thereto along the radial datum 330, so that it is centrally oriented. Next, the inner flow ring 220 may be positioned within the assembly jig 610 in alignment with the diffuser vanes 212, according to the block labeled 730. Slots 221 may be provided in the inner flow ring 220 for insertion of the diffuser vanes 212 to facilitate alignment. The deswirler band 240 may then be positioned against the inner wall of the circular band 611, according to the block labeled 740.

Next, a plurality of deswirler vanes 230 may be positioned between the deswirler band 240 and the rim 224 of the inner flow ring 220, according to the block labeled 750. The deswirler vanes 230 may be individually inserted and positioned in opposing slots 223, 225 provided in the rim 224 and the deswirler band 240, respectively, and then temporarily held in place using standard weldment methodology, such as spot welding or tack welding. The deswirler vanes 230 may be constructed as a single casting or by stamping.

The diffuser vanes 212 and deswirler vanes 230 may then be permanently attached along their ends to the inner flow ring 220 and the deswirler band 240, according to the block labeled 760, using standard fabrication techniques known to the industry such as brazing. Finally, the integrated assembly 200 may be re-indexed from the second datum plane 320 back to the first datum plane 310, according to the block labeled 770, so that final machining may be accomplished for other critical controlled dimensions such as the flow path and the flatness of the integrated assembly 200 along the first datum plane 310.

It should be understood, of course, that the foregoing relates to preferred embodiments of the invention and that modifications may be made without departing from the spirit and scope of the invention as set forth in the following claims.

We claim:

1. An integrated assembly for a centrifugal compressor on an engine body of a gas turbine engine with a central axis, the centrifugal compressor having an impeller disposed to receive an axially oriented airflow, accelerate the airflow, and expel the airflow radially, the centrifugal compressor further having a compressor body, the integrated assembly comprising:

a shroud coaxial with the central axis, the shroud surrounding the impeller and providing an inlet for receiving the axially oriented airflow, the shroud having a plurality of diffuser vanes integral with the shroud and extending axially from a downstream surface of the shroud;

a ring coaxial with the central axis, the ring having an upstream surface disposed for fixed attachment to the plurality of diffuser vanes, the ring with a rim extending axially from a perimeter of the ring and away from the downstream surface of the shroud;

a band disposed coaxially with and surrounding the rim, the band having an upstream edge proximate to the downstream surface and a downstream edge distal to the downstream surface, the band having an outwardly-extending flange along the downstream edge;

a plurality of deswirler vanes attached to both the rim and the band to hold the rim and the band in spaced relationship; wherein the radially oriented airflow expelled from the impeller flows through a diffuser passage formed between the shroud and the ring and flows thereafter through a deswirler passage formed between the rim and the band; and a compressor housing disposed to removably attach the shroud to the compressor body;

wherein the compressor housing forms a redirection passage between the diffuser passage and the deswirler passage.

2. A centrifugal compressor for attachment to a gas turbine engine, the centrifugal compressor comprising:

an impeller coaxial with a central axis of the engine body;

an inlet receiving an axially oriented airflow and directing the airflow through the impeller;

an integrated assembly comprising:

a shroud coaxial with and orthogonal to the central axis, the shroud surrounding the impeller, the shroud with a downstream surface;

a ring coaxial with and orthogonal to the central axis, the ring having an upstream surface;

the ring with a rim orthogonal with the upstream surface and extending axially from a perimeter of the ring and away from the downstream surface of the shroud;

a plurality of diffuser vanes affixed to both the upstream surface of the ring and the downstream surface of the shroud, wherein the surfaces are held in fixed and spaced relationship to form a diffuser passage for radially directed airflow from the impeller;

a continuous band disposed coaxially with and surrounding the rim, the band having an upstream edge proximate to the downstream surface of the shroud and a downstream edge distal to the downstream surface of the shroud, the band having a flange that extends away from the central axis; and a plurality of deswirler vanes affixed to both the rim and the band wherein the rim and the band are held in fixed and spaced relationship to form a deswirler passage for axially directed airflow;

a compressor housing coaxial with and orthogonal to the central axis, the compressor housing having a compressor housing edge, the compressor housing edge removably attached to an engine housing and holding the integrated assembly therebetween against the engine housing;

wherein the airflow radially expelled from the impeller flows through the diffuser passage formed between the shroud and the ring, becomes redirected axially as it flows through a passage formed between the compressor housing and the ring, and flows thereafter through the deswirler passage formed between the rim and the band.

3. The centrifugal compressor described in claim 2, wherein the diffuser vanes are integral with the shroud.

4. The centrifugal compressor described in claim 2, wherein the flange is formed along the downstream edge of the band, wherein the integrated assembly does not extend beyond a plane formed by the flange.

5. The centrifugal compressor described in claim 4, wherein the flange is captured by a compressor housing edge and held firmly against the engine housing.

6. The centrifugal compressor described in claim 5, wherein the integrated assembly further comprises:

a first datum plane defined by an upstream edge of the compressor housing;

a second datum plane defined by the plane of the downstream edge of the compressor housing edge, the second datum plane parallel with the first datum plane;

a first dimension between the first datum plane and the second datum plane; and a second dimension between the first datum plane and the flange plane;

wherein the first dimension is greater than the second dimension when the integrated assembly is attached to the engine housing.

7. The centrifugal compressor described in claim 6, wherein the second dimension is greater than the first dimension.

8. The centrifugal compressor described in claim 6, wherein an axial tolerance scalar defined by the difference between the first dimension and the second dimension is between 0 inch and about 0.0 15 inches.

9. The centrifugal compressor described in claim 8, wherein a wall formed along the diffuser passage, the redirection passage, and the deswirler passage is continuous, wherein the wall is defined by the ring and the rim.

10. The centrifugal compressor described in claim 2, wherein:

the radial airflow from the diffuser passage is redirected to an axial airflow by a redirection passage formed by the compressor housing and the ring and the rim of the ring, and the diffuser passage is configured to receive the axial airflow.

11. A method of fabricating an integrated assembly for a centrifugal compressor, the method comprising the steps of:

providing an assembly jig defining a first datum plane and a second datum plane parallel with the first datum plane, the assembly jig being coaxial with and orthogonal to a central axis;

centrally positioning a compressor shroud between the first and second datum planes about a central axis of the assembly jig, the compressor shroud having a plurality of diffuser vanes extending from a downstream surface of the compressor shroud;

positioning an inner flow ring within the assembly jig in alignment against the diffuser vanes, the inner flow ring having a rim around a perimeter of the inner flow ring, the rim extending away from the downstream surface;

positioning a deswirler band in alignment with the second datum plane and surrounding the rim;

positioning a plurality of deswirler vanes between the deswirler band and the rim of the inner flow ring; and affixing the plurality of diffuser vanes and the plurality of deswirler vanes to the inner flow ring and the deswirler band to form the integrated assembly.

12. The method of claim 11, wherein the step of affixing the plurality of diffuser vanes and the plurality of deswirler vanes to the inner flow ring and the deswirler band to form the integrated assembly is accomplished by brazing.

13. The method of claim 11, wherein the step of positioning a plurality of deswirler vanes between the deswirler band and the rim of the inner flow ring comprises the steps of:

casting the plurality of deswirler vanes; and positioning the plurality of deswirler vanes between the deswirler band and the rim of the inner flow ring by spot welding.

* * * * *